US005500235A

United States Patent [19]

Mendenhall et al.

[11] Patent Number: 5,500,235

[45] Date of Patent: Mar. 19, 1996

[54] METHOD FOR MAKING A MICROWAVABLE, EXPANDABLE PACKAGE

[75] Inventors: Abraham H. Mendenhall, Morris County, N.J.; Joseph F. Irace, St. Louis County, Mo.

[73] Assignee: Packaging Concepts, Inc., St. Louis, Mo.

[21] Appl. No.: 55,792

[22] Filed: May 3, 1993

Related U.S. Application Data

[63] Continuation of Ser. No. 524,446, May 17, 1990, abandoned, which is a continuation-in-part of Ser. No. 342,747, Apr. 25, 1989, abandoned, which is a continuation-in-part of Ser. No. 129,132, Dec. 7, 1987, abandoned.

[51] Int. Cl.[6] ..... B65D 81/34

[52] U.S. Cl. ..... 426/394; 426/410; 426/107; 219/744; 156/276; 428/209; 428/211

[58] Field of Search ..... 426/107, 234, 426/243, 126, 127, 394, 410; 219/10.55 E; 428/209, 211; 156/276

[56] References Cited

U.S. PATENT DOCUMENTS

| | | | |
|---|---|---|---|
| 2,830,162 | 4/1958 | Copson et al. | 426/107 |
| 4,156,806 | 5/1979 | Teich et al. | 426/243 |
| 4,158,760 | 6/1979 | Bowen et al. | 426/243 |
| 4,190,757 | 2/1980 | Turpin et al. | 99/451 |
| 4,210,674 | 7/1980 | Mitchell | 426/113 |
| 4,230,924 | 10/1980 | Brastad et al. | 426/107 |
| 4,267,420 | 5/1981 | Brastad | 426/107 |
| 4,461,031 | 7/1984 | Blamer | 426/113 |
| 4,553,010 | 11/1985 | Bohrer et al. | 426/107 |
| 4,640,838 | 2/1987 | Isakson et al. | 426/113 |
| 4,641,005 | 2/1987 | Seiferth | 426/107 |
| 4,656,325 | 4/1987 | Keefer | 426/107 |
| 4,713,510 | 12/1987 | Quick et al. | 426/243 |
| 4,735,513 | 4/1988 | Watkins | 426/127 |
| 4,806,718 | 2/1989 | Seaborne et al. . | |
| 4,808,780 | 2/1989 | Seaborne et al. . | |
| 4,818,831 | 4/1989 | Seaborne . | |
| 5,002,826 | 3/1991 | Pollart et al. | 426/107 |
| 5,306,512 | 4/1994 | Blamer | 426/107 |
| 5,308,945 | 5/1994 | Vanhandel et al. | 426/107 |

FOREIGN PATENT DOCUMENTS

| | | | |
|---|---|---|---|
| 56-56534 | 5/1981 | Japan | 426/243 |

OTHER PUBLICATIONS

PCT/US86/02204 Apr. 1987, Archibald.

*Primary Examiner*—Steven Weinstein
*Attorney, Agent, or Firm*—Paul M. Denk

[57] ABSTRACT

The method of forming a microwaveable package, generally from a plurality of liners of material, and incorporating a heat-assist layer preferably intermediately of the liners of material, which said heat assist material comprising powdered carbon, that is originally applied to the inner surface of one of the intended liners, and in register at that location where the layer is desired within the formed microwave package. The material may be imprinted by a gravure or other roller application onto the inner surface of one of said liners of material, or adhesive applied or added onto that adhesive that laminates the liners together, in order to assure that proper and convenient registration of the layer within the laminate material, and provide for its location within the formed package preferably at a lower position where the food or other product is arranged, during microwaving, to attain that necessary heat assist desired from its addition.

1 Claim, 2 Drawing Sheets

METHOD FOR MAKING A MICROWAVABLE, EXPANDABLE PACKAGE

CROSS-REFERENCE TO RELATED APPLICATION

This application is designated as a continuation of the application of the same inventors, having Ser. No. 07/524,446, filed on May 17, 1990, and now abandoned, which is a continuation-in-part of patent application having Ser. No. 07/342,747, filed on Apr. 25, 1989, and now abandoned, which is a continuation-in-part of the patent application having Ser. No. 07/129,132, filed on Dec. 7, 1987, and now abandoned, said applications being owned by a common assignee.

BACKGROUND OF THE INVENTION

This invention relates to an improved package for containing, serving and cooking particulate food stuffs such as popcorn in a microwave oven, and for an improved method of making such packages.

It is commonly known that early attempts to produce paper containers for cooking particular foods in microwave ovens such as illustrated in U.S. Pat. No. 3,973,045 issued to Brandberg, et al., involved a compact gussetted bag made from multiplys of paper and incorporated a flexible body which is expanded to accommodate the increased volume of popped popcorn. However, while the Brandberg container functions desirably for its intended purpose, it still leaves up to twenty-five percent (25%) of the corn kernels unpopped and five percent (5%) burned after exposure for approximately two and one-half minutes of microwave cooking time. Accordingly, attempts have been made throughout the years to remedy these deficiencies.

In recent years, patents to Teich, et al., U.S. Pat. No. 4,156,806, and to Ishino, et al., U.S. Pat. No. 4,335,291, disclose methods for improving the efficiency of popcorn containers which rely primarily on concentrating microwave energy at the base of a conically shaped bowl where corn kernels were clumped for the purpose of improving the efficiency and speed of popping. One important embodiment of that technology as disclosed by Teich used a microwave lossy powder of particulate material in the base area. The lossy material heated up and radiated that generated heat to the kernels located closest to it, thereby adding to the heat induced in the corn kernels by direct impingement of the microwave energy on the same.

Later, however, it was taught by Bohrer, et al. in U.S. Pat. No. 4,553,010, that the popcorn would pop more rapidly and more efficiently by avoiding the clumping of corn kernels in one area of a popping container and designing for the packaging of said kernels to rest in uniform proximity to the lossy material and being spaced no more than an average kernel's diameter away from the said lossy material. To accomplish such a feat, the lossy material was applied as a layer at the bottom of a flat container and the kernels generally evenly distributed in an unclumped fashion along said bottom of the microwaveable package or container. The bottom coating of such containers were in the form of a coated panel placed into the package.

It has been found that the prior applications and designs of the metallized lossy microwave assist materials have intrinsically required the use of lubricants such as greases, oils, or butter, which have proven to have an insulating character deterrent to the creation of heat in the microwave ovens during usage. A means for applying metallized lossy material which would not require said lubricants would be a substantial advancement in the art.

More importantly, the placement of a lossy coated panel in the bottom of gussetted bags, although not described in detail in the prior art, has proven to be extremely difficult and expensive to manufacture. Additionally, the requirement of uniformly scattering popcorn kernels at the bottom of the bag is cumbersome and time-consuming, and difficult to sustain. Also, coated panels are difficult to regulate precisely in their functioning, and it is difficult to determine precisely the type of metallic powder or flakes which are needed to retain the heat generated by the microwave cooking process.

Finally, it is of necessity during ordinary filling operations that particulate food stuffs such as popcorn will ordinarily be clumped together and particularly when oils or greases are applied therewith, and a means for developing a heat-assist which compensates for such clumping during filling without any detrimental effects, while at the same time creating the efficiencies of cooking from a heat-assist to the kernels which are unclumped without the awkward manufacture of a bottom coated panel is a substantial advancement in the art.

Other art known to applicants which include the metallization of a liner material, such as paper, or polymer, are shown in U.S. patents to Beckett, U.S. Pat. No. 4,398,994, U.S. Pat. No. 4,517,045, and U.S. Pat. No. 4,552,614. U.S. Pat. No. 3,647,508, shows the concept of patterned application of metal onto films, such as plastic film. In addition, metal application to a film is shown in the U.S. Pat. No. 4,242,378, U.S. Pat. No. 4,532,002, U.S. Pat. No. 4,448,636, U.S. Pat. No. 3,935,334, U.S. Pat. No. 3,985,597, U.S. Pat. No. 2,748,031, and U.S. Pat. No. 2,139,640. In addition, Canadian patent No. 1,153,069 discloses a food receptacle for microwave cooking, that includes a conductive elemental metal incorporated into such a receptacle to enhance microwave cooking, or at least to achieve some surface browning of the heated food product. See also U.S. Pat. No. 3,671,270; U.S. Pat. No. 3,853,280; U.S. Pat. No. 4,267,420; U.S. Pat. No. 4,450,180; U.S. Pat. No. 3,993,045; U.S. Pat. No. 4,219,573; U.S. Pat. No. 4,038,425; and, U.S. Pat. No. 4,292,332.

SUMMARY OF THE INVENTION

Accordingly, it is a principal object of the present invention to eliminate the complete need for normal lubricants as previously employed in lossy metallic microwave assist materials heretofore used for absorbing microwave energy in food packages and generating additional heat therefrom.

It is a further object of the present invention to incorporate a means for applying the metallic material for heat-assist in flat bottom gussetted microwaveable bags without the need for departing from conventional package forming procedures as heretofore required when adding a coated bottom panel.

Still another object of the present invention is to provide an improved microwaveable package incorporating metallic heat-assist for more exact regulation and control than obtained through previous heat-assist techniques.

Yet another object of this invention is to provide a microwave-assist composition between inner and outer liners forming a gussetted bag, and which intermediate microwave interactive layer is applied to at least one of the liners as a registered pattern while laminating the plies during the initial stages of formation of the packaging material during container forming.

Still another object of this invention is to provide food containers, particularly for use in the microwave setting, which are manufactured having a layer of metallic flakes and conductive powders that are printed or otherwise rolled onto an acrylic or other material ply or layer that is then formed into the packaging material used for forming the containers during a high speed packaging manufacture and assembly operation.

Another object of the present invention is to eliminate the need to have particulate food stuffs uniformly scattered across the bottom panel of microwaveable heat-assist packages.

A final but principally important object of the present invention is to provide a microwave package which permits the cooking of microwaveable foods to a higher efficiency through an integral heat-assist which will enable food products that require more time in exposure at higher levels of heat to be cooked or processed without damage to the package and with improved results to the food, especially during usage in lower wattage microwave ovens.

Briefly stated, the above-described objects and others are fulfilled by a method for making a laminated, flat bottom, gussetted microwaveable package in accordance with this invention which comprises pre-registering a functional layer of a special compounded coating between the plys of the package. This layer of compounded coating between the plys is placed at specific locations, so as to be formed during usage into a multi-sided chamber. This chamber creates an enclosed area for the food to gain the maximum or enhanced heat through the concentration and conservation of the heat generated by the microwave energy in the cooked food itself. The process of preregistering this layer or strip of metallic or other conductive material allows one to control its exact emplacement in relationship to the food just above the bottom wall of the package, and which has been found to generate the maximum heat for achieving a cooking assist. By virture of the assembling of containers having this type of internal chamber, the existing filling systems may be employed without the previous critical need to scatter the food uniformly along the bottom of the intended microwave package, such as heretofore required, as for example, in preparing popcorn for popping. Also, the previous need to package in a conical shaped container to achieve some clumping the food stuff is hereby negated. While there is controlled heat generated by the conductivity of the active layer, a secondary benefit is also realized from the conservation of heat generated by the process of microwaves passing through the metallic layer and the food itself.

In the specific manufacture of the type of package envisioned for this invention, preferably the package will be formed from a pair of liners or layers of material, with one of the liners, upon a surface that will be arranged intermediate the liners when brought together, having imprinted thereon, by a standard printing or coating process. The active coating so applied becomes positioned between inner and outer plys of either the paper, polymer, or the like, that are then formed into the package itself. This particular procedure can be performed in the initial stages of the formation of such packages upon the assembly line, and the aforesaid conductive material can be imprinted into place, at a precise pattern where the active layer is eventually desired to be located within the packages when mass produced. Thus, it is the registering of the active layer, that provides for the precise location of the metallic layer at the desired location within the packages as cut, folded, and formed, during assembly operations. To form a bag of the desired size with printing in specified regions, the bag making equipment must be equipped to sense the exact location of the print on the outside ply. To register the active coating intermediate the plys, the equipment must be modified to control the coating station also in registration with the print.

BRIEF DESCRIPTION OF THE DRAWINGS

The above and other advantages of this invention will become more apparent from the following description taken in connection with the accompanying drawings, wherein.

DESCRIPTION OF THE PREFERRED EMBODIMENT

Figure 5:
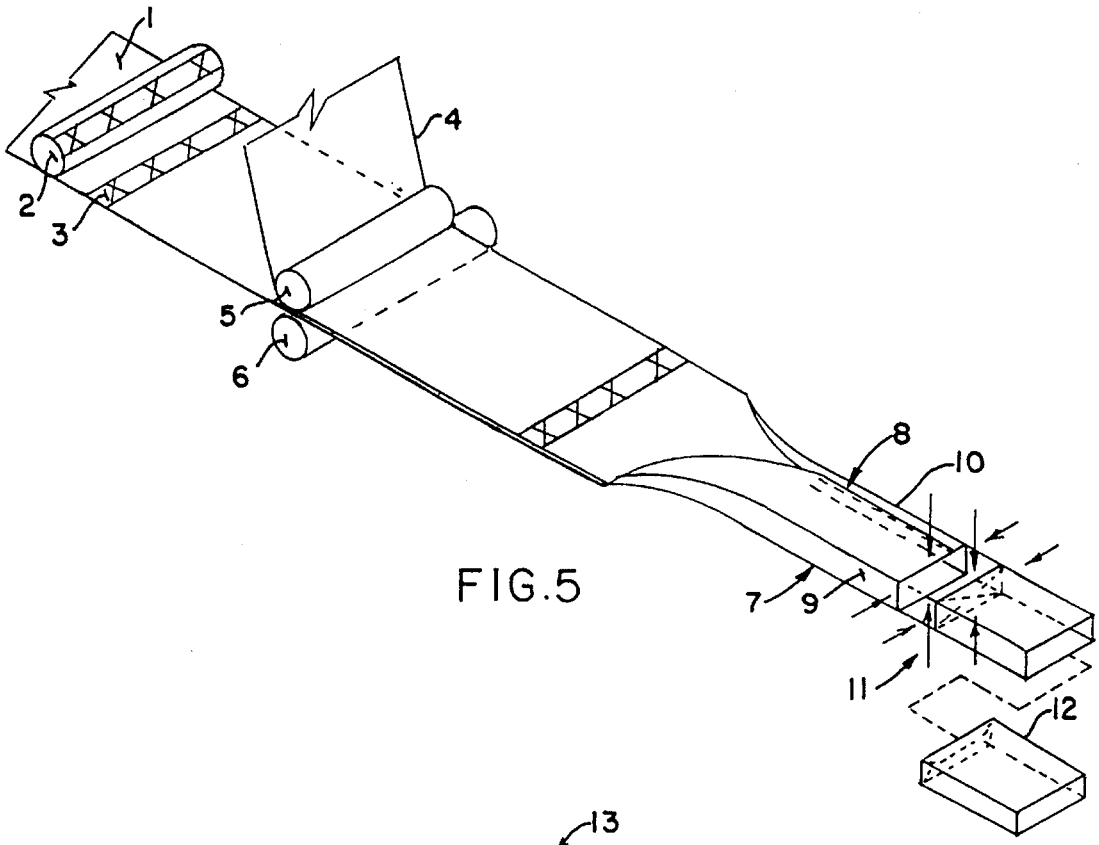
FIG. 5 is a schematic view of the bag forming operation showing the printing and registering of the metallic strip, the lamination of the plys of material, and the tubing operation which forms the gussetted flat bottom bag.

Referring more particularly to the drawings wherein like characteristics of reference numbers designate like parts throughout the several views, there is shown in FIG. 5 a paper web or other material ply 1 which forms the eventual outer layer of the microwaveable package laminate of the present invention. This material may be any conventional paper previously employed for mirowaveable packages as for example kraft, glassine, or may even be a polymer film, such as polyethylene. A roll 2 for registering the active compound applied as an ink coating or paste is shown and upon registration prints the metallic strip or other coating composition layer 3 onto the surface of the outer paper layer or may even do so upon an intermediate ply (not shown). The microwave active material may be any combination of materials which can be processed to function like an ink, coating, paste, or the like. The active material will consist of particulate matter such as flakes, powders and platelets, suspended in a binding resin, or other adhesive. A solvent carrier which may be water or organic solvent may be employed to produce a workable viscosity. Electrolytes may be present in solution in the carrier.

Various microwave active materials with select levels of effectiveness are known. These include metallic flakes and powders and their oxides, especially aluminum, silver, copper and iron. Particulate alloys include iron and steel and those of chromium and nickle. Certain non-metallics, such as carbon in its various forms, i.e. graphite, may also be utilized. Other materials as known to those skilled may also be employed. It is required that the active particles generate electrical eddy currents at microwave frequency of 2450 MHz, more or less. The conductivity must be poor enough to produce resistance heating. The active material will be 40 to 90% by weight of the dry weight of the coating.

The function of the binders will be to hold the particles onto the chosen substrate when dry, and to conduct the heat generated within the particles to the substrate against the food product. Suitable binders include starches and their modified forms, derivatives of cellulose. Synthetic resins including acrylics and polyvinyl acetates are also effective.

An example of one embodiment of the above-described development may be as follows. As noted, the objective of this invention is to provide a unique method of obtaining additional heating characteristics in microwave packaging. The uniqueness is embodied in being able to combine standard printing and lamination techniques and processes with a printable fluid material containing, for example, carbon. The difficulties of utilizing carbon, which is conductive and interactive with the microwaves to produce heat, are overcome by combining the carbon with special adhesive type compounds and temperature control agents. The latter is used to keep the temperature from getting too hot.

For example, a standard finely ground (divided) carbon such as Kodak carbon, generally known as Norit 211, and which is available from Kodak Corporation, of Rochester, N.Y., is mixed with a binder type adhesive such as the National Starch product identified NP Kote 80. This Kote 80 adhesive is a corn starch adhesive, available from National Starch, of Bridgewater, N.J. Obviously, other types of adhesives, as previously explained, even of the resin type, such as polyvinyl alcohol, polyvinyl acetate, and EVA, may be utilized as the adhesive within this composition. The carbon ingredient and the binder type adhesive are combined with a heat control material such as the Soleum Industries' product identified as the Mural 632, which is a heat control composition, comprising a refined clay, available from this Company as located at Fairmount, Ga. Through this combination of ingredients, a 20% water solution of the Kote 80 is heated to 190° F. until a viscosity is obtained that provides the body for the mixture which acts as a binder to hold the carbon intact in solution. Then the Nordit 211 is added at the rate of 120 grams to 1000 grams of the previous solution. To the 1000 grams of the vehicle solution now is added 100 grams of the Mural 632. Also included is 1 gram each of sodium and calcium chloride to provide enhancement for the conductivity of the solution, as applied, and to minimize drying in low humidity conditions. The entire composition is then mixed to ensure that the mixture is uniform in content. The mixture is then applied to paper or other substrate by the conventional printing methods, as defined in this application, such as of the Flexo or Gravure type. Thus, the formulation as aforementioned, in the coating form, may be applied by this printing or by other coating techniques as known in the industry. Roll coating techniques may likewise be utilized. Through printing, this places the conductive mixture in the exact location in the package to be formed, so as to have a precise location in the position of the formed package to be readily receptive to the microwave energy and to heat the food or other product contained therein. Microwave heat-assist materials can process foods without the use of normal lubricants. Such earlier lubricants as are utilized in the art are known, and are used in conjunction with other heat-assist metals. But, usage of such are not necessary for the purposes of this invention. The compounds of the present invention, for example copper, are thus devoid of the insulating character that forms the deterrent to the creation of heat in the microwave oven. Additionally, although the metals are conductive, the specific location of these metals and their types which are applied just above the bottom wall formed from the laminated material act to conserve the heat generated by the process of the microwaves passing to and through the contained food product. While the metal layers comprising the five walls of the formed package are conductive, the heat generated by such conduction is not the sole benefit of the heat assist in the present invention. The chamber thus formed is quite effective regardless of whether the particulate food stuff such as popcorn are clumped during filling, or even if they are scattered uniformly along the bottom of a container. The need for a bottom coated panel of lossy metallic material may be seen to be no longer necessary.

FIG. 5 further shows the intended thermoplastic ply of film 4 forming an inner liquid retarding or are impervious layer for the intended package. This inner layer may consist of any of several materials of construction, including for example polyethylene, an acrylic, or the usual thermoset polymers or other flexible films that may be used in conjunction with the holding, heating and cooking of preferably food products. The inner layer serves to create a barrier that prevents weepage of moisture and oils from the food product, and particularly popcorn. Additionally, adhesives may be applied between the liners 1 and 4, to adhere the same together, and it may be just as likely that as the adhesive may be applied by another roller application, such as just prior to the roller stations 5 and 6, with the adhesive being applied upstream from this location, where the films are laminated together, and the metallic material may be simply flaked or powder applied onto the applied adhesive, at select locations, in order to provide that pre-registration of the metal upon the film at a location where it will end up laminated within the finished package where desired and required.

Adhesives that may be utilized for this purpose may include the usual heat sealable adhesives, that are resin based, such as polyvinyl alcohol, or PVA. Other adhesives such as polyvinyl acrylonitrile, or polyvinyl acetate, or related adhesives, may be utilized. The lamination station showing the rollers 5 and 6 is at the point at which the laminates are desirably converged and pressed together to form the uniform material from which the packages are cut, rolled, and formed. FIG. 5 also shows the tube forming station 7, the formed and side seal 8, and the creation of the side gussets at 9 and 10. The cutoff station 11 is at a point where the bottom is formed, and the finished bag 12 may be readily seen to be rectangle in its a general configuration.

Figure 6:
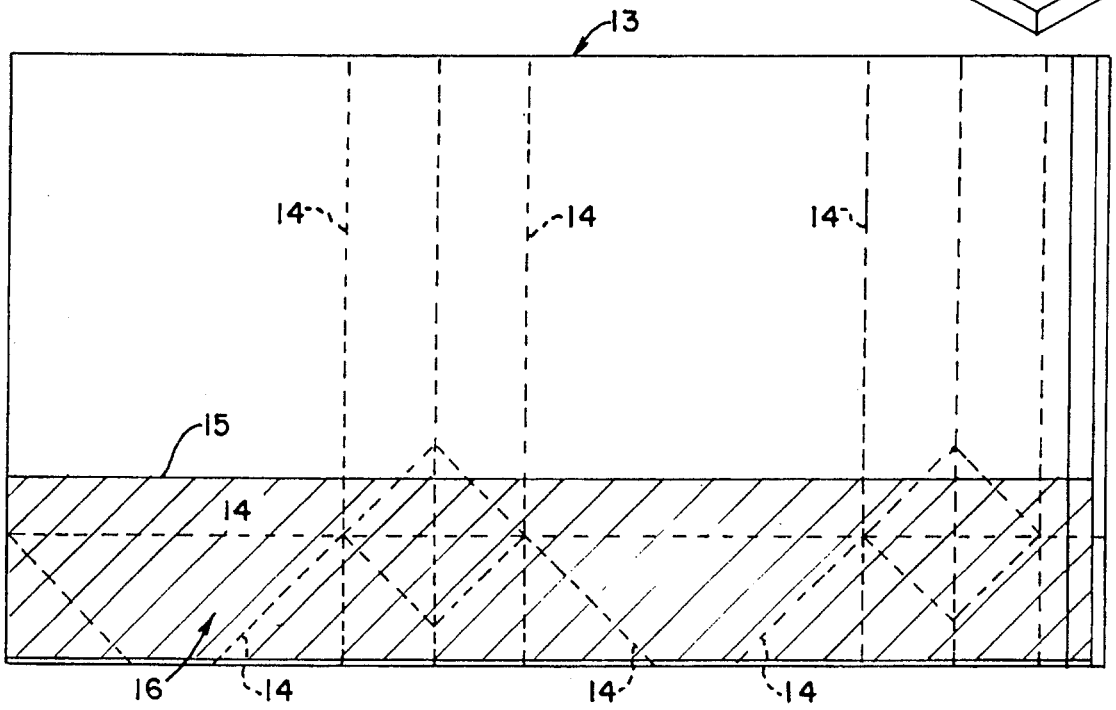
FIG. 6 shows a layout of the bag blank of the present invention prior to its tubular forming.

FIG. 6 shows a segment of the sheet or blank 13 of laminate material that is intended to form the package, with the dotted lines 14 indicating fold lines. The area designated by line 15 shows the intended upper margins of the metallic application, with the shaded area 16 schematically indicating the applied metallic coating, and disclosing the point at which the metal is registered onto the sheet.

Figure 1:
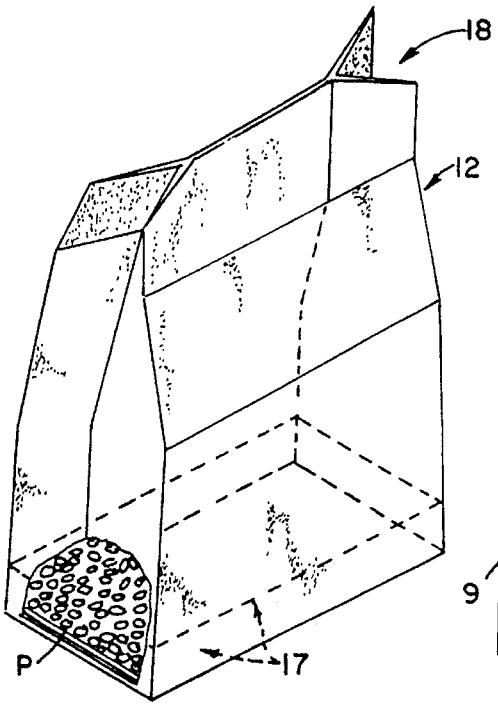
FIG. 1 is a perspective view of a finished gussetted bag showing the particulate food stuff such as popcorn shown within the bag and the heat-assist strip where located by dotted lines.

FIG. 1 shows a filled bag 12 having been filled with the particulate material, preferably popcorn kernels P. Additionally, one can readily see the chamber formed from the metallic stip 17, and which may also extend into the bottom panel of the formed package. At location 18, one can see how the top portion of the package is closed for forming the seal.

Figure 2:
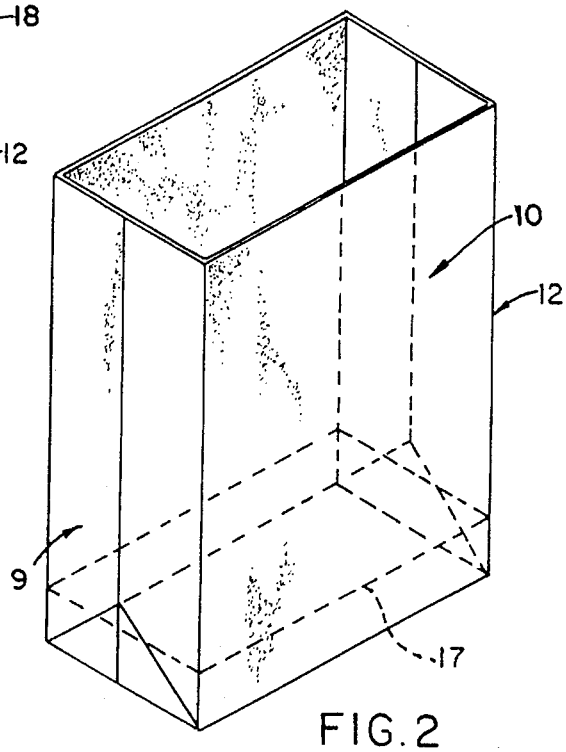
FIG. 2 is an additional perspective view of the flat bottom gussetted microwaveable package prior to sealing of the top and prior to filling.

FIG. 2, one can see an illustration of the tubular formed and gussetted bag 12 prior to a filling and sealing of the top of the package.

Figure 3:
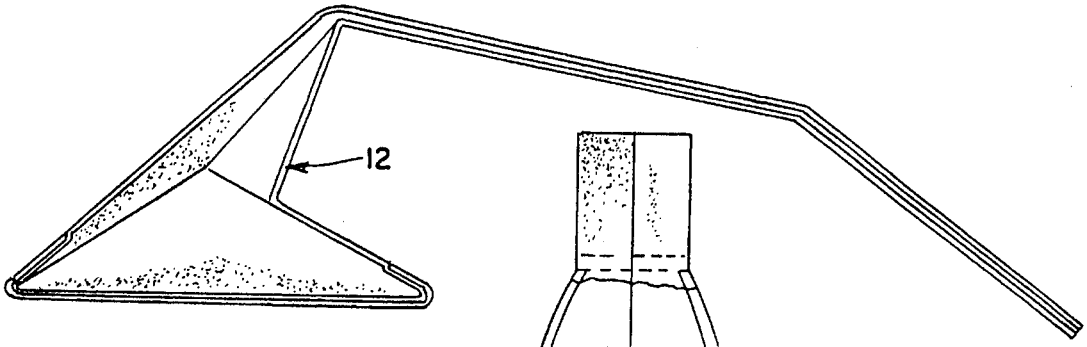
FIG. 3 is a side view of a partially folded gussetted bag of this invention.

FIG. 3 shows the food ladened package, such as containing a quantity of popcorn kernels, of the type as shown in FIG. 1, and which has been folded over to aid in the convenience of its packaging, storage, shipment, and prior to usage.

Figure 4:
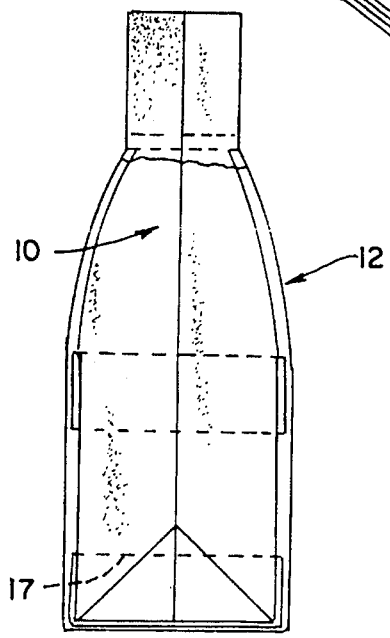
FIG. 4 is a side view of FIG. 1.

FIG. 4 discloses the sealed bag, as it is erected upright, as in the microwave oven, in preparation for its usage and application.

From the foregoing, it will be apparent that all of the objectives of this invention have been achieved in the microwave heat-assist package shown and described. All parts of the device are made of materials having adequate strength, but yet being relative absorbtive of microwave energy. The presently described device and method as pointed out are adaptable to various modifications and embodiments which may have different dimensional thermal conducting variations. However, it is to be understood that various modifications and changes in the structures shown and described may be made by the skill of the art without departing from the spirit of the invention as expressed in the accompanying claims. Therefore, all matters shown and described are to be interpreted as illustrated and not in a limiting sense.

Having thus described the invention what is claimed and desired to be secured by Letters Patent is:

1. A method for making a microwavable, expandable package formed from a sheet of laminated material and having sidewalls, gussets and a bottom wall, said sheet of laminated material having an outer layer of flexible paper and an inner layer of heat sealable, fluid impervious thermoplastic resin, the improvement which comprises:

aligning a continuous sheet of flexible paper with a printing roller, printing a strip of microwave energy absorptive composition onto said continuous sheet of flexible paper by transferring said microwave energy composition from said printer roller to said continuous sheet of flexible paper, said microwave energy absorptive composition comprising a fluid adhesive containing a powdered carbon, said powdered carbon being finely ground such that upon deposition of said microwavable energy absorptive composition on said paper and exposure of said composition to microwave energy, said composition absorbs microwave energy and generates heat as a result of the microwave energy absorption, said fluid adhesive comprising a binder type fluid resin based adhesive and said microwave energy absorptive composition further comprising a conductive enhancing and drying controlling ingredient consisting of sodium chloride and calcium chloride in an amount sufficient to enhance conductivity of the composition as applied and to minimize drying in low humidity conditions, said microwave energy absorptive composition further comprising a refined clay in a temperature control effective amount, and said fluid resin adhesive is selected from the group consisting of polyvinyl alcohol, polyvinyl acrylonitrile and polyvinyl acetate, after printing said strip of microwave energy absorptive composition onto said continuous sheet of paper, laminating said inner layer of heat sealable, fluid impervious thermoplastic resin onto the roller printed continuous sheet of paper to provide a laminate of paper and thermoplastic resin with the strip of microwave energy absorptive composition secured therebetween, then cutting and folding the laminate to form discrete packages detached from the continuous sheet such that each package has an outer layer of flexible paper and an inner layer of heat sealable, fluid impervious thermoplastic resin, said aligning and printing steps being repeated along spaced intervals on said continuous sheet of flexible paper such that after cutting and folding to form discrete packages, each package contains one strip and wherein each strip of microwave energy absorptive composition printed in said printing step is printed on said continuous sheet at a position such that said printing of said sheet and the cutting and folding of said laminate creates discrete packages wherein the microwave energy absorptive composition is located across the bottom wall of each of the packages and partially up the sidewalls of each of the packages such that the printed microwave energy absorptive composition serves as a surrounding heat assist such that more uniform heating of the food product in the packages can be achieved without requiring the food to be uniformly scattered across the bottom wall.

* * * * *